US007503292B2

(12) United States Patent
Holmdahl

(10) Patent No.: US 7,503,292 B2
(45) Date of Patent: Mar. 17, 2009

(54) SYSTEM FOR A TWO-STROKE COMBUSTION ENGINE WITH CONTROLLED ADDITIONAL AIR

(75) Inventor: Mikael Holmdahl, Jonkoping (SE)

(73) Assignee: Husqvarna AG, Huskvarna (SE)

( * ) Notice: Subject to any disclaimer, the term of this patent is extended or adjusted under 35 U.S.C. 154(b) by 0 days.

(21) Appl. No.: 11/570,202

(22) PCT Filed: Jun. 15, 2004

(86) PCT No.: PCT/SE2004/000935

§ 371 (c)(1),
(2), (4) Date: Feb. 16, 2007

(87) PCT Pub. No.: WO2005/124138

PCT Pub. Date: Dec. 29, 2005

(65) Prior Publication Data

US 2007/0181084 A1 Aug. 9, 2007

(51) Int. Cl.
*F02B 25/00* (2006.01)
*F02B 23/10* (2006.01)
*F02D 9/08* (2006.01)

(52) U.S. Cl. ..... 123/73 PP; 123/336; 123/585

(58) Field of Classification Search ..... 123/73 PP, 123/400, 336, 442, 585–586
See application file for complete search history.

(56) References Cited

U.S. PATENT DOCUMENTS

| | | | | |
|---|---|---|---|---|
| 4,075,985 | A | 2/1978 | Iwai | |
| 6,000,683 | A | 12/1999 | Van Allen | |
| 6,708,958 | B1 * | 3/2004 | Warfel et al. | 261/45 |
| 6,877,723 | B2 * | 4/2005 | Martinsson et al. | 261/23.3 |
| 6,896,245 | B2 * | 5/2005 | Suzuki et al. | 261/23.2 |
| 6,928,996 | B2 * | 8/2005 | Tobinai | 123/586 |
| 6,957,633 | B2 * | 10/2005 | Toda et al. | 123/65 R |
| 7,104,253 | B1 * | 9/2006 | Dow et al. | 123/342 |
| 7,104,526 | B2 * | 9/2006 | Mavinahally | 261/46 |
| 2003/0213464 | A1 * | 11/2003 | Geyer et al. | 123/336 |
| 2007/0169724 | A1 * | 7/2007 | Holmdahl et al. | 123/26 |

FOREIGN PATENT DOCUMENTS

| | | | |
|---|---|---|---|
| WO | 0151782 | A1 | 7/2001 |
| WO | 2004005692 | A1 | 1/2004 |

* cited by examiner

*Primary Examiner*—Hai H Huynh
(74) *Attorney, Agent, or Firm*—Pearne & Gordon LLP

(57) ABSTRACT

The present invention relates to a system (1) for supplying an air-fuel mixture to a two-stroke internal combustion engine (2), comprising a carburettor (3) having a throttle valve (4) and a choke valve (5). The system further has a transfer passage (6) between a crankcase (7) chamber and a combustion chamber (8) of said engine (2). A supply conduit for additional air (9) is having an air valve (10) for said additional air, and said supply conduit for additional air (9) is being adapted to discharge the additional air into the top portion of said transfer passage (6) during a portion of a cycle of said two-stroke internal combustion engine (2). Further the air valve (10) is controlled by the throttle valve (4) so as to affecting a air valve opening state when said throttle valve opening state is affected, and the opening state of said air valve (10) is delimited by a choked state of said choke valve (5) regardless of the throttle valve opening state.

17 Claims, 4 Drawing Sheets

SYSTEM FOR A TWO-STROKE COMBUSTION ENGINE WITH CONTROLLED ADDITIONAL AIR

FIELD OF THE INVENTION

The present invention relates to a system for a two-stroke crankcase scavenged internal combustion engine, in which an air passage for additional air is arranged between an air inlet and the upper part of a transfer duct. Fresh air is added at the top of the transfer duct and is intended to serve as a buffer against the air/fuel mixture below. This buffer is mainly lost out into the exhaust outlet during the scavenging process. The fuel consumption and the exhaust emissions is thereby reduced.

TECHNICAL BACKGROUND

For conventional two-stroke combustion engines it is well known how to control the air/fuel mixture, but a high level of unburned hydrocarbon emissions is produced because in this engine the scavenging process is performed exclusively by a mixture of air and fuel. Some of the air/fuel mixture mixes with the exhaust gases and thereby some unburned fuel is lost out with the exhaust gases.

Two-stroke combustion engines using the additional air technique during the scavenging are previously known in the art. These engines reduce fuel consumption and exhaust emissions. But for these prior art engines it is a problem to control the air/fuel mix during normal operation and during start. One common start procedure for a conventional two-stroke engine is with a closed choke valve and a fully open throttle valve. In combination with a "conventional" additional air technique this will provide too much air for optimal starting conditions. Since these kind of engines are used in many different environments and subjected to troublesome conditions it is desired to achieve a robust operation. One issue with engines using the additional air technique is to also provide good start properties. The operational conditions for this kind of engines can be of varying temperature, humidity, atmospheric pressure etc.

Hence, there is a need for an improved system for a two-stroke engine using the additional air technique to achieve good properties for start and normal operation. Further it is an advantage to combine proper operation of such an engine with lean and environmentally friendly operation. Finally it would be advantageous to provide a robust, cost effective and high-quality system for this kind of engine.

SUMMARY OF THE INVENTION

The object of the present invention is to provide a system for supplying an air/fuel mixture to a two-stroke internal combustion engine that overcomes at least some of the above mentioned matters and present an improved control of the air/fuel mixture to the engine.

According to the invention there is provided a system for supplying an air-fuel mixture to a two-stroke internal combustion engine, comprising a carburettor having a throttle valve and a choke valve. The system further has a transfer passage between a crankcase chamber and a combustion chamber of said engine, a supply conduit for additional air having an air valve for said additional air. The supply conduit for additional air being adapted to discharge the additional air into the top portion of said transfer passage, either directly through a check valve or via a recess in an engine piston, during a portion of a cycle of said two-stroke internal combustion engine. The air valve is controlled by said throttle valve so as to affecting a air valve opening state when said throttle valve opening state is affected, and the opening state of said air valve is delimited by a choked state of said choke valve regardless of the throttle valve opening state. In prior art two-stroke engines with additional air there is a problem with too much additional air through the supply conduit when the choke valve in the carburettor is closed. The present invention provides an improved solution for two-stroke engines using additional air. With this solution it is possible to control the air/fuel mixture during start-up, normal operation and other conditions for the engine.

Advantageously the air valve is resiliently connected to said throttle valve so as to affecting a air valve opening state when the throttle valve opening state is affected and the choke valve in a choked state is adapted to delimit the opening state of said air valve regardless of the throttle valve opening state. This resiliently connection between the air valve and the throttle valve can be performed in different ways, for example by levers connected by a spring, spring loaded rod with flexible length, telescopic rod, oval holes in combination with springs or levers with interacting teeth. In an alternative design of the system a control device for controlling the supply of additional air due to the choke opening state can be provided adjacent to the air valve, with influence from the choke valve.

Preferably the shaft of said throttle valve is provided with a throttle valve lever, which lever is interconnected with a air valve lever, provided on a shaft of said air valve. In an embodiment of the invention this interconnection is provided by a rod resiliently connecting the throttle valve lever and the air valve lever. This interconnection is, as described above, dependent of the position of the choke valve. Consequently there is a variable control between the throttle valve and the air valve, which is also depending on other parameters than an direct and stiff connection to the throttle valve opening state. The resilient means for controlling the opening state of the additional air valve can be provided direct between the throttle lever and the spring actuated lever, which both are provided on the throttle shaft.

Alternatively the resilient means for controlling the opening state of the additional air valve can be provided at the valve for additional air, in both cases for example a rod can be used to connect the throttle lever with a lever provided at the valve for additional air.

Advantageously the throttle valve lever is interconnected, via a spring, with said air valve. The spring is stiff enough to bring the air valve to operation when the throttle valve is operated, but not too stiff to prevent the choke valve from preventing opening of the air valve when this is undesired.

Advantageously the interconnection of the throttle valve lever and the air valve is via a spiral spring attached to the throttle valve lever and acting on a spring actuated lever rotably connected with said shaft of the throttle valve. There are alternatively designs for this, for example by means of electronically control means or other mechanical mechanisms.

Preferably the air valve lever is interconnected with the spring actuated lever by a rod. This rod is transferring the movement from the throttle valve to the air valve. In the current embodiment of the invention there is a spring performing this transferring movement from the throttle lever via the spring to the spring actuated lever and further to the air valve via said rod. By different characteristic of the spring the transferring movement, and hence the opening characteristic of the air valve, can be controlled. By adjusting the stiffness of the transferring spring and/or adjusting a play for when the transferring spring shall start to operate the air valve it is possible to enable a certain operation characteristic for the air valve, such as for example a delayed opening of the air valve compared to when the throttle valve is opening.

Advantageously the spiral spring describes a plane parallel to a plane defined by said throttle valve lever and the spring actuated lever. That means the spring is a flat spiral spring. But it is also possible to provide a corresponding effect by a helical, conical, leaf, torsion or other kind of spring which is connected between the throttle valve lever and the spring actuated lever.

Advantageously the spring actuated lever is provided for interaction with a choke valve lever, when altering said choke valve opening state for limiting the opening state of said air valve, when the choke valve has left its open position. That means that for example during the start procedure of an engine, if the carburettor is choked the flow of additional air through the supply conduit to the engine will be limited in relationship to the degree of choking in the carburettor.

Advantageously, at least one of said spring actuated lever and said choke lever is provided with a cam for interaction, when said choke valve is moved from an open state. Either there is a cam provided on the spring actuated lever or the choke lever, alternatively both levers can be provided with cams or other geometrical shapes for interaction. The shape of the cam will affect the interaction and consequently it is possible to control the limitation of the opening characteristic of the air valve in relation to the opening state of the choke valve.

Advantageously the throttle valve and the choke valve are having at least one mutually interlocking start state, in which each of said valves are locked in a predefined opening state. This interlocking state can be provided by levers connected to the throttle valve and the choke valve respectively, by for example a mechanism of interlocking levers provided with springs. These levers are either integrated in the throttle and choke levers on the front of the carburettor, or else provided as separate levers, for example on the opposite, rear, side of the carburettor.

Advantageously the throttle valve shaft and said choke valve shaft are each being provided with lever-like shackles, in which one of said shackles, in an end directed towards the other shackle, is being provided with a lug in which the other shackle, in the mutually interlocking start state where the additional air valve is in a closed position, is lockingly engaging. The choke lever and throttle lever can be operated in either end of their shafts, such as on the front side of the carburettor or alternatively on levers connected to the shaft on the rear side of the carburettor.

Advantageously the throttle valve and said choke valve are having at least two mutually interlocking start states, in which each of said valves are locked in predefined opening states. These two interlocked start states can be provided with different settings for the throttle and choke valve, for example for different environmental conditions. An advantage with these, above mentioned, interlocking start states is that the operator can use both hands for starting the engine, since it is not necessary to operate the interlocked choke and throttle. The second interlocking state might provide a state of more open throttle and/or choke than the first interlocking state, consequently the second state used to give problems, in prior art, with to much additional air. Since the invention will control the additional air in relation to the opening of the choke valve there will be an improved control of the additional air.

Advantageously the mutually interlocking start state of the throttle valve and said choke valve provides the throttle valve, the choke valve and the air valve in substantially closed positions. Since the interlockingly engaged position preferably is a position where the choke valve and the throttle valve both are in substantially closed or in a slightly open position, the additional air valve is in a substantially closed position according to the spirit of the invention.

The above mentioned system is provided for two-stroke internal combustion engines and provided for supplying an air-fuel mixture to the engine. Particularly this system according to the invention will provide improved starting and running conditions compared to prior art two-stroke engines with additional air.

The system according to the invention can be implemented on hand-held working tools provided with a two-stroke internal combustion engine, it is also possible to implement the invention on other applications including two-stroke combustion engines.

A machine provided with a system according to the invention for controlling of the supply of additional air is possible to start with the combination fully open throttle and fully closed choke valve. Another advantage with the system according to the invention is the possibility to use a conventional choke valve in the carburettor. Which further provides simple technical solutions, since all parts are provided on the carburettor.

Using the technique with additional air will reduce the loss of fuel and provide a economically (lean) and environmental-friendly two-stroke engine. The present invention provides a solution for the previous unsolved problem with control of the additional air during for example starting of the engine, consequently the technique with additional air can now be fully utilized.

Common cold start conditions is that the choking causes a low pressure, due to the throttling, this in combination with a rich air-fuel mix during a cold start will give remaining condensation of fuel inside hoses, conduits and the rest of the system. By using the present invention these cold start conditions can be optimised for good performance.

BRIEF DESCRIPTION OF THE DRAWINGS

By way of example, embodiments of the present invention will now be described with reference to the accompanying figures of drawings in which.

DETAILED DESCRIPTION OF PREFERRED EMBODIMENTS

A first embodiment of the present invention related to a system 1 for supplying air/fuel mixture to a two-stroke engine 2 will be described in more detail in the following, with reference to the accompanying drawings.

Figure 1:
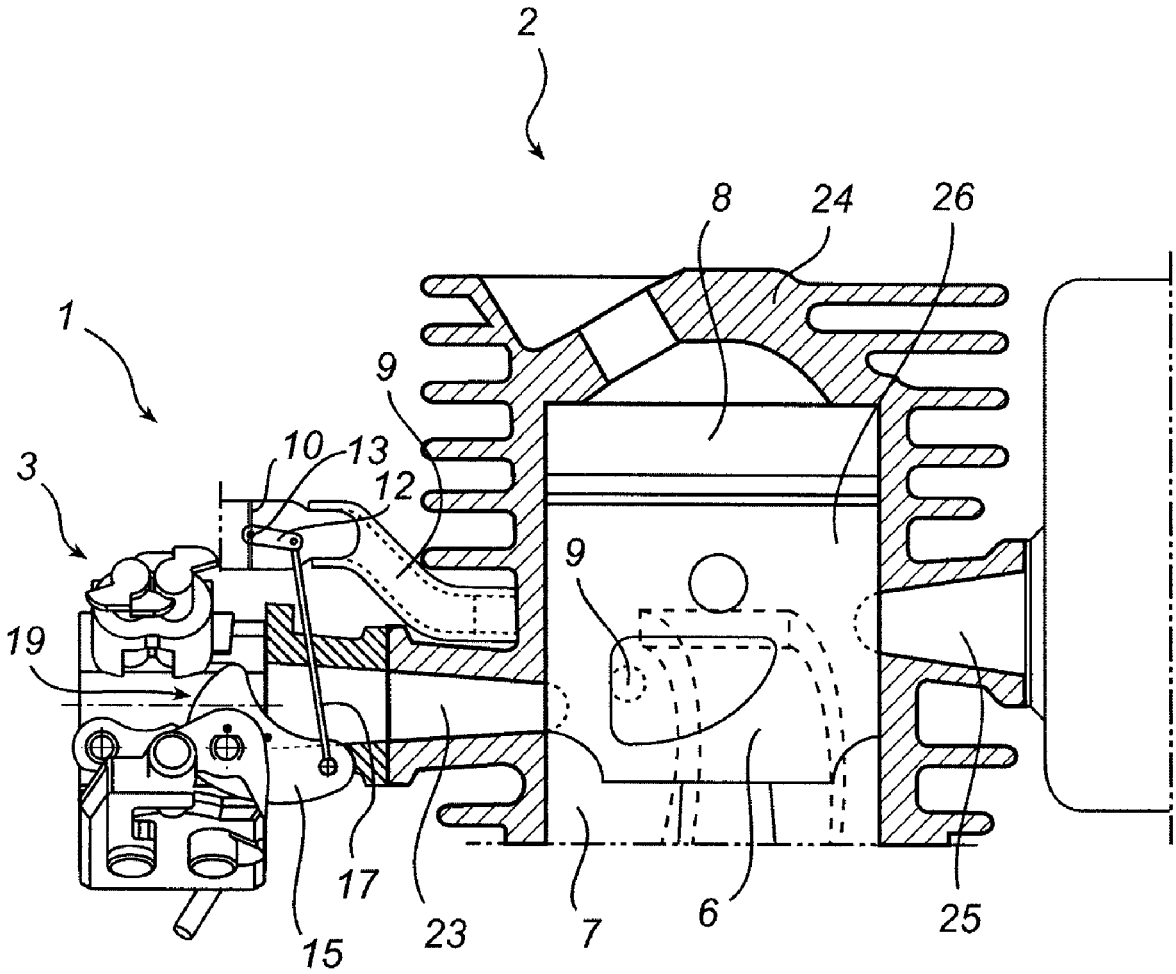
FIG. 1 is a partially sectioned side-view showing a two-stroke engine with a system for supplying additional air during the scavenging process.

Referring to FIG. 1, a two-stroke engine 2 with carburettor 3 and a system for additional air is shown. The carburettor 3 is provided at an intake 23 of the cylinder 24. Further is the piston 8 provided for letting air/fuel mix into the crankcase 7 and fresh air, for the scavenging process, into the upper part of the transfer passage 6 during a portion of a engine cycle. During a stage of the engine cycle the air/fuel mixture is compressed in the crankcase 7 and thereafter the exhaust gases is pressed out through the exhaust port 25 by the compressed air/fuel mixture. The buffer of fresh air in the transfer passage 6, provided from the additional air system, enter the combustion chamber 8 before the air/fuel mixture. Consequently the risk for uncombusted fuel to accompany the exhaust gases out from the combustion chamber 8 is reduced. The additional air is provided into the transfer passage 6 through a channel 9 and an aperture in the cylinder 24. Which aperture, during a portion of the engine cycle, lead into a recess in the piston 26 fluidly connected to the transfer passage 6. The channel 9 for additional air could also connect directly to a transfer passage 6 via a check valve or so called Reed valve. The flow of additional air into the transfer passage 6 is substantially simultaneously with the flow of air/fuel mixture into the crankcase 7.

The additional air channel 9 is provided with a air valve 10 for controlling the additional air to the engine 2. The air valve 10 for additional air is interconnected with the throttle valve 4 of the carburettor 3, this is to synchronous control the opening state of the throttle and the supply of additional air via the air valve 10.

To obtain a rich air/fuel mixture during the start procedure of the engine a choke valve 5 is provided in the carburettor 3 to choke the flow of air through the carburettor 3. Commonly used start settings for a two-stroke engine 2 is fully open throttle valve 4 and closed choke valve 5. If the throttle valve 4 is directly interconnected with the additional air valve 10, such as with a fixed rod 17, the air valve 10 will be open during the above described starting conditions. If this is the case the engine 2 will take the main air supply through the additional air channel 9 and consequently not enough fuel will reach the engine 2. To avoid this there is a non-rigid connection between the air valve 10 and the throttle valve 4, in this embodiment this is provided by a spring 14 connecting two levers provided on the throttle shaft 16. The first of the two levers is the throttle lever 11 fixed connected to the throttle shaft 16 for adjusting the opening state of the throttle valve. The second lever 15, which is provided for control of the air valve, and rotably arranged on the throttle shaft 16 is further connected to the throttle lever 11 via a spring 14. This resilient interconnection between the throttle lever 11 and the spring actuated lever 16 for additional air provides a flexible control of the air valve 10. The choke valve 5 is provided with a choke lever 18 for adjustment of the choke valve 10, this choke lever 18 is provided for interaction with the spring actuated lever 15. When the choke valve 5 is in the open or a partially open state the choke lever 18 will interact with the spring actuated lever 15 in such a way that the opening state of the air valve 10 is limited. For example one or both of the spring actuated lever 15 and the choke lever 18 is provided with a cam 19 to facilitate a controlled interaction between the levers.

The opening characteristics of the air valve 10 controlled by the throttle valve 4 is further controlled by the spring 14 connecting the spring actuated lever 15 and the throttle lever 11. It is for instance possible to predetermine that the air valve 10 shall have a delayed opening time, or angle, compared to when the throttle valve 4 is opening. The interconnection between the spring actuated lever 15 and the throttle lever 11 provides the opportunity to control the relationship of opening speed and the opening characteristic between the air valve 10 and the throttle valve 4, for example linear or non-linear characteristic. This is performed by adjusting the spring stiffness and/or characteristic of the spring 14 connecting the spring actuated lever 15 and the throttle lever 11, and the springs provided for holding the air-, throttle- and choke valves in their respectively initial positions.

FIG. 2*a-d* shows an embodiment of the current invention with choke lever 18, throttle lever 11 and spring actuated lever 15.

Figure 2A:
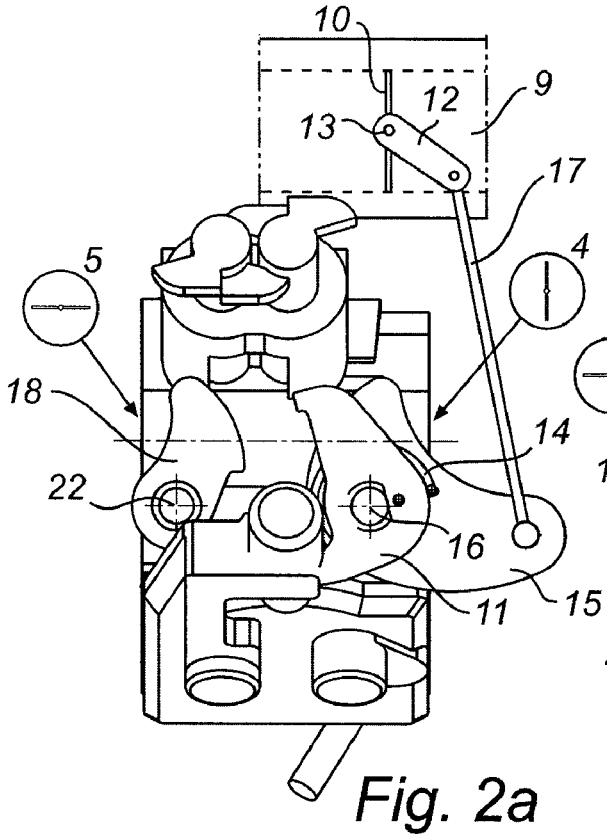
FIG. 2 is a side-view of a carburettor front-side with a supply conduit for additional air.

FIG. 2*a* depicts the carburetor 3 in an unaffected state, the levers are held in their respective initial positions by springs. In this unaffected initial state the choke valve 5 is completely open, the throttle valve 4 is closed and the additional air valve 10 is closed.

Figure 2B:
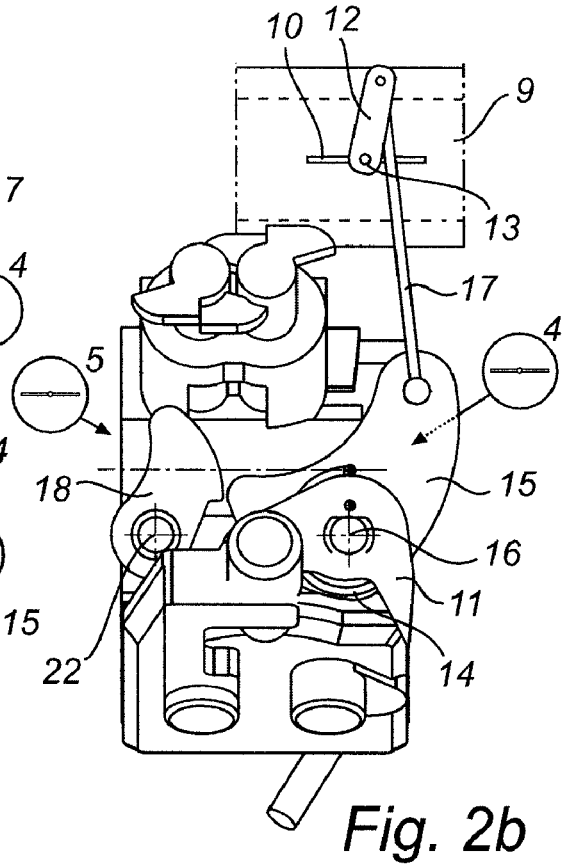

FIG. 2*b* shows the carburetor 3 in a state of normal fully open throttle operation. The choke valve 5 is in an unaffected fully open position and the throttle valve 4 is fully open. Since the choke valve 5 is open, the choke lever 18 is not preventing the spring-actuated lever 15 to move. The interconnecting spring 14 between the spring actuated lever 15 and the throttle lever 11 will in this state affect the spring actuated lever 15 to rotate with the throttle lever 11, consequently the additional air valve 10 will in this state be in an open position.

Figure 2C:
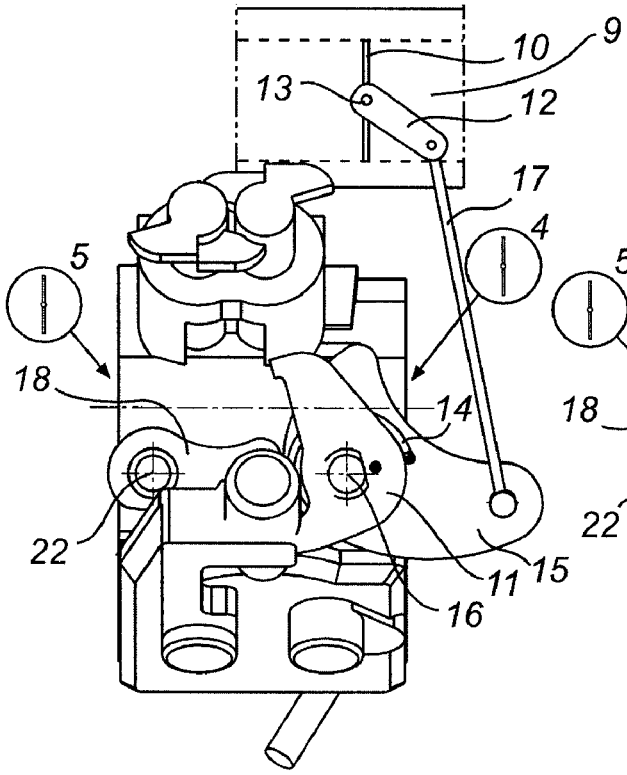

FIG. 2*c* shows the carburetor 3 in a state where the choke valve 5 is closed and the throttle valve 4 is in an unaffected closed position. This could for example be during the start procedure when still no opening of the throttle is performed. Since the choke valve 5 is in a closed position the choke lever 18 will block the rotation of the spring actuated lever 15 by the interacting cams provided on these levers. Hence, if the throttle valve 4 in this state will be opened the throttle lever 4 will not be able to bring the air valve 10 to an open position, at least not more open than what is permitted from the interacting choke lever 18.

Figure 2D:
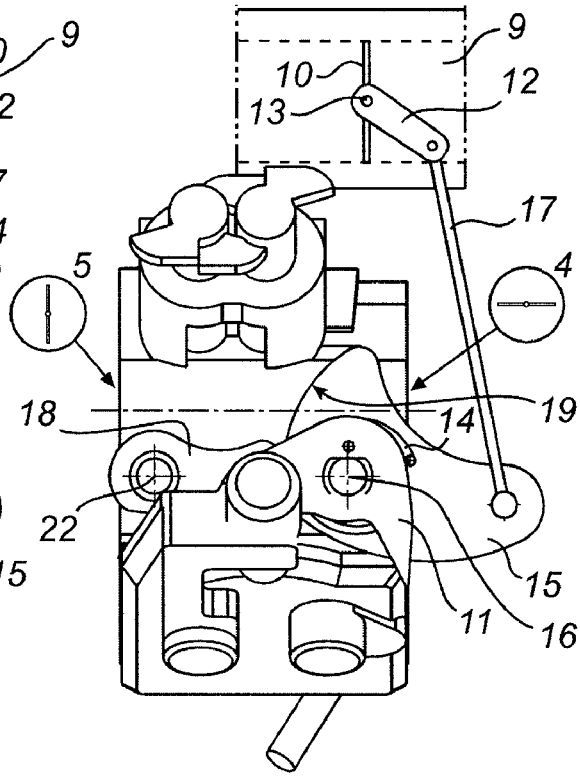

FIG. 2*d* shows the carburetor 3 in a state where the choke valve 5 is fully closed and the throttle 4 is in a fully open position. This is an example of a generally used starting state for two-stroke engines. The choke lever 18 is interacting with the cam 19 of the spring actuated lever 15 and consequently the spring-actuated lever 15 will remain in a closed position. During opening of the throttle lever 11 the spring 14 between the spring actuated lever 15 and the throttle lever 11 will be tensioned, but since the choke lever 18 is blocking the rotation of the spring actuated lever 15 the throttle lever 11 will not be able to bring the spring actuated lever 15 in the rotation to an open position.

This state shown in FIG. 2*d* can be obtained either by first operating the choke valve 5 to a closed position and thereafter operating the throttle lever 4 to the opened position, or alternatively the throttle lever 4 can be operated first, to an open position, and thereafter closing of the choke valve 5 will, by interaction between the levers, force the additional air valve 10 to rotate back to a closed position.

Figure 3:
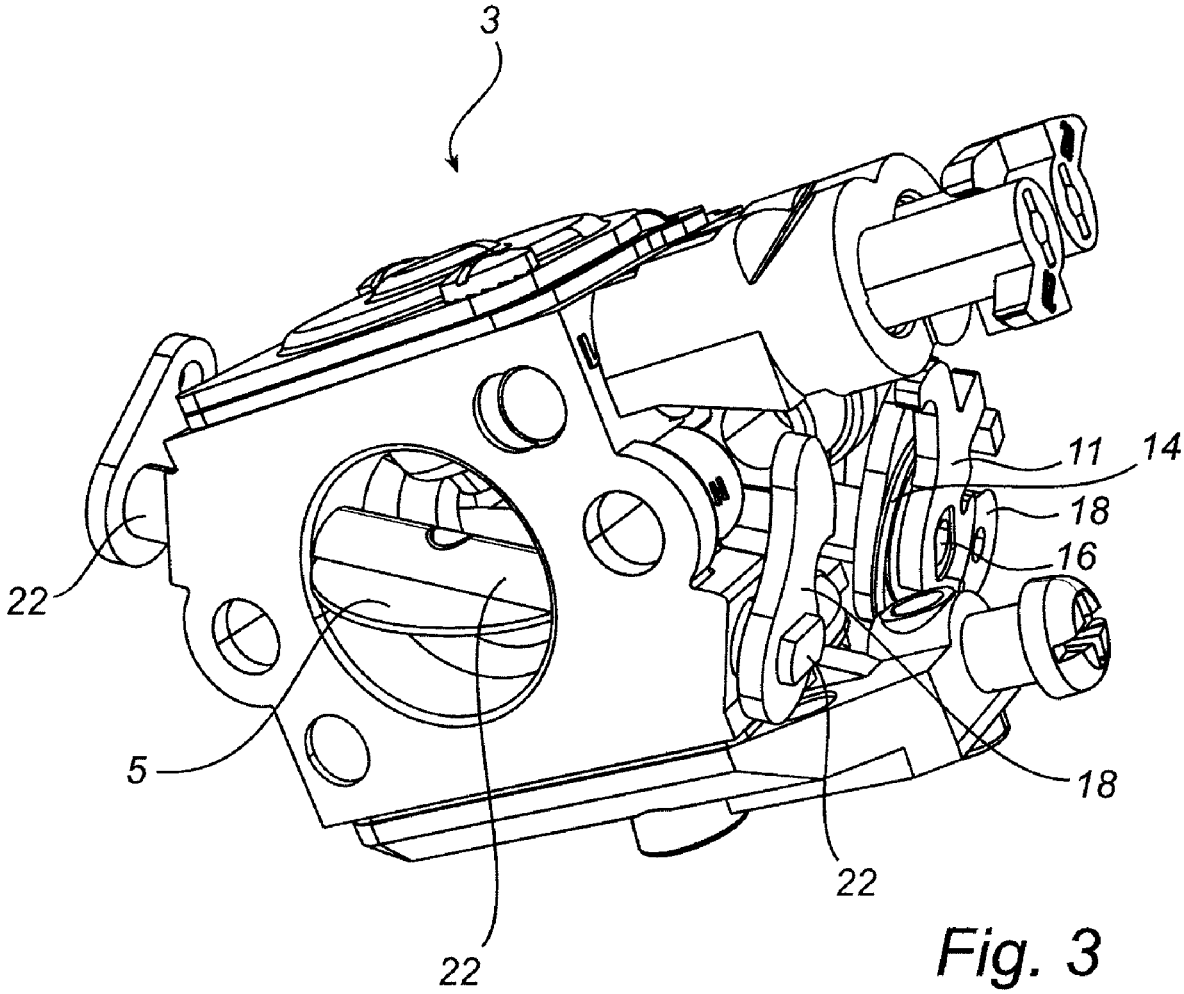
FIG. 3 is a perspective view of a carburettor.

FIG. 3 depicts the carburetor 3, the intake of air to the carburetor 3 is controlled by the choke valve 5, which is attached to the trough choke shaft 22. There is a choke lever 18 and a second choke lever 28 attached to the choke shaft 22. Also the throttle shaft 16 is a shaft going through the carburetor 3. A throttle lever 11 is attached to the shaft 16 on one side and a second throttle lever 27 is attached on the opposite side of the carburetor 3. In another embodiment there is a second 28 and third 29 choke lever (shown in FIG. 4*a-c*) assembled to the throttle shaft 18 on the opposite side of the carburetor in relation to the throttle lever 11.

Figure 4A:
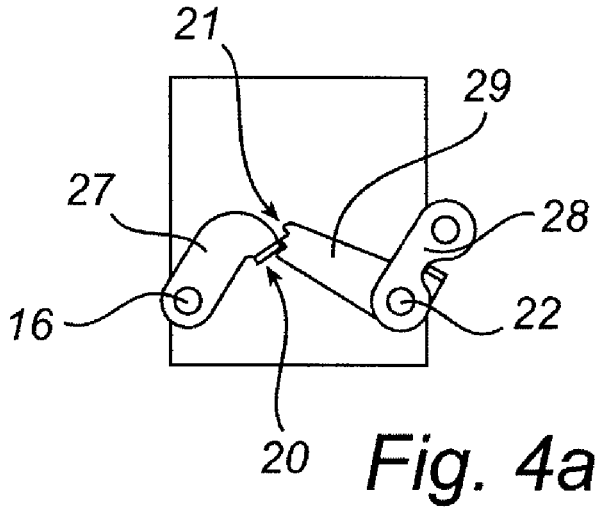
FIG. 4 is a side-view of a carburettor rear-side with levers for throttle and choke valves.
Figure 4B:
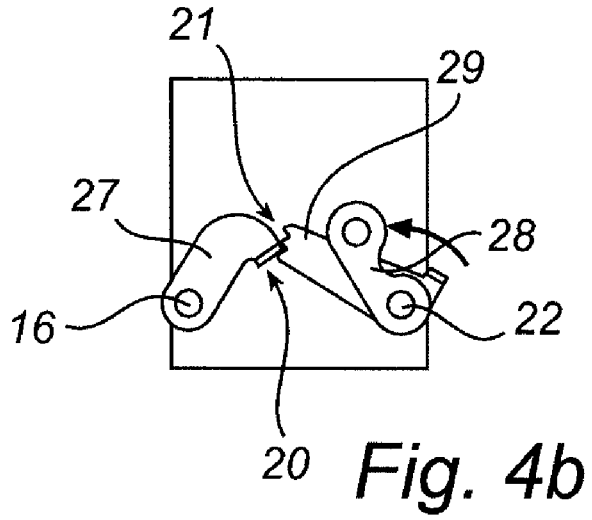
Figure 4C:
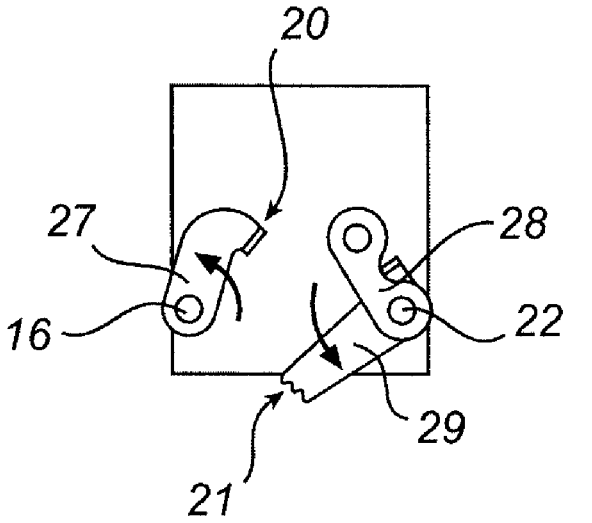

FIG. 4*a-c* shows an embodiment of the current invention from an opposite side of the carburetor compared to the FIGS. 2*a-d*. On this opposite side there is second 28 and third 29 choke levers provided and further a second throttle lever 27.

FIG. 4*a* depicts the carburettor with the second throttle lever 27 and choke levers 28, 29 in an alternatively starting position, that means alternatively to fully choke and fully open throttle. In this, alternatively, state the throttle valve 4 can for example be in an almost closed position and also the choke valve 5 in an almost closed position. The invention provides the additional air valve 10 to be in an accurately closed position also in this alternative starting state. To obtain this alternative starting state, sometimes called start gas state, the second throttle lever 27 is provided with a lug 20 for mutually interlocking with the third choke lever 29, which lever is provided with shackles. In this embodiment of the invention the third choke lever 29 is provided with two abutments 21 for providing two start gas states with different settings of the opening state of the throttle valve 4 and the choke valve 5.

To reach the mutually interlocking state for the levers the choke valve 5 is rotated towards the closed position. In a predetermined position the abutments of the choke lever 21 will interlock with the spring loaded second throttle lever 27 provided with a lug 20. This first interlocking state is shown in FIG. 4*a*. If the second choke lever 28 is further rotated the third choke lever 29 will be brought in the rotation and the lug 20 of the second throttle lever 27 will reach the second abutment of the third choke lever 29.

FIG. 4*b* shows the carburettor 3 with second throttle lever 27 and second and third 28, 29 choke levers in the alternatively starting state, start gas state, for the engine 2. The second throttle lever 27 and the third choke lever 29 is mutually interconnected and an operator do not need to operate the choke or throttle controls during the starting moment. In this state of interlocking between the levers it is possible to operate the choke valve 5 from the substantially closed position towards a more open position of the choke valve 5, with the second throttle lever 27 and the third choke lever 29 still in the interlocking position. This feature is useful during the start-up-phase of the engine. It is possible to operate the choke valve in the interlocking state due to that the third choke lever 29 is fixedly connected to the choke shaft 22. The second choke lever 28 is spring loaded towards the open position and further rotably connected to the choke shaft 22, a lug on the third choke lever 29 will force the second choke lever 28 to follow the third choke lever in one direction when the choke valve 5 is closed and there is no interlocking between throttle and choke lever.

FIG. 4*c* depicts the carburettor 3 with second throttle lever 27 and choke levers 28, 29 in an unaffected initial position. To reach this initial position from the mutually interlocking state, shown in FIG. 4*a-b*, the throttle lever, on the opposite side, has to be rotated towards a more open position of the throttle valve 4, which will release the interlocking state between the levers 27, 29 and the spring loaded choke valve 5 and levers will return to the initial fully open state for the choke valve 5.

Although the present invention has been described in connection with particular embodiments thereof, it is to be understood that various modifications, alterations and adaptations may be made by those skilled in the art without departing from the spirit and scope of the invention.

The invention claimed is:

1. A system (1) for supplying an air-fuel mixture to a two-stroke internal combustion engine (2), comprising a carburettor (3) having a throttle valve (4), with a throttle shaft (16) and a throttle valve lever (11) fixedly connected thereto, and a choke valve (5), with a choke valve shaft (22) and a choke lever (18) fixedly connected thereto, and a choke valve (5), said system further has a transfer passage (6) between a crankcase (7) chamber and a combustion chamber (8) of said engine (2), wherein a supply conduit for additional air (9) having an air valve (10) for said additional air, said supply conduit for additional air (9) being adapted to discharge the additional air into the top portion of said transfer passage (6), either directly through a check-valve or via a recess in an engine piston (26), during a portion of a cycle of said two-stroke internal combustion engine (2), characterised in that a spring actuated lever (15) is rotatably arranged on the throttle shaft (16) and connected to the throttle valve lever (11) via a spring (14), and said air valve (10) is controlled by said spring actuated lever (15) of the throttle valve (4) so as to try to affect an air valve opening state when said throttle valve opening state is affected, and in that the opening state of said air valve (10) is delimited by a choked state of said choke valve (5) regardless of the throttle valve opening state, through interaction between said choke lever (18) and said spring actuated lever (15).

2. A system (1) according to claim 1, wherein the lever (11) is interconnected with a air valve lever (12), provided on a shaft (13) of said air valve.

3. A system (1) according to claim 1, wherein said throttle valve lever (11) is interconnected, via the spring (14), with said air valve (10).

4. A system (1) according to claim 3, wherein said interconnection is via the spiral spring (14) attached to said throttle valve lever (11) and acting on the spring actuated lever (15) rotably connected with said shaft (16) of the throttle valve.

5. A system (1) according to claim 4, wherein said air valve lever (13) is interconnected with the spring actuated lever (15) by a rod (17).

6. A system (1) according to claim 1, wherein said throttle valve (4) and said choke valve (5) are having at least one mutually interlocking start state, in which each of said valves are locked in a predefined opening state.

7. A system (1) according to claim 6, wherein said throttle valve shaft (16) and said choke valve shaft (22) each are being provided with lever-like shackles, in which one of said shackles, in an end directed towards the other shackle, is being provided with a lug (20) in which said other shackle (21), in said mutually interlocking start state where said additional air valve (10) is in a closed position, is lockingly engaging.

8. A system (1) according to claim 6, wherein said throttle valve (4) and said choke valve (5) are having at least two mutually interlocking start states, in which each of said valves are locked in predefined opening states.

9. A system (1) according to claim 6, wherein said mutually interlocking start state of the throttle valve (4) and said choke valve (5) provides the throttle valve (4), the choke valve (5) and the air valve (10) in substantially closed positions.

10. A two-stroke internal combustion engine (2) provided with a system (1) for supplying an air-fuel mixture according to claim 1.

11. A hand-held working tool provided with a two-stroke internal combustion engine (2) having a system (1) for supplying an air-fuel mixture according to claim 1.

12. A system (1) according to claim 1, wherein said spring (14) is a spiral spring (14) attached to said throttle valve lever (11) and acting on a spring actuated lever (15).

13. A system (1) according to claim 12, wherein said spiral spring (14) describes a plane parallel to a plane defined by said throttle valve lever (11) and the spring actuated lever (15).

14. A system (1) according to claim 12, wherein said spring actuated lever (15) is provided for interaction with the choke valve lever (18), when altering said choke valve opening state for limiting the opening state of said air valve (10), when the choke valve (5) has left its open position.

15. A system (1) according to claim 12, wherein at least one of said spring actuated lever (15) and said choke lever (18) is provided with a cam (19) for interaction, when said choke valve (5) is moved from an open state.

16. A system (1) according to claim 12, wherein said air valve lever (13) is interconnected with the spring actuated lever (15) by a rod (17).

17. A system (1) for supplying an air-fuel mixture to a two-stroke internal combustion engine (2), comprising a carburettor (3) having a throttle valve (4), with a throttle shaft (16) and a throttle valve lever (11) fixedly connected thereto, and a choke valve (5), with a choke valve shaft (22) and a choke lever (18) fixedly connected thereto, and a choke valve (5), said system further has a transfer passage (6) between a crankcase (7) chamber and a combustion chamber (8) of said engine (2), wherein a supply conduit for additional air (9) having an air valve (10) for said additional air, said supply conduit for additional air (9) being adapted to discharge the additional air into the top portion of said transfer passage (6), either directly through a check-valve or via a recess in an engine piston (26), during a portion of a cycle of said two-stroke internal combustion engine (2), characterised in that a spring actuated lever (15) is rotatably arranged on the throttle shaft (16) and connected to the throttle valve lever (11) via a spring (14), and said air valve (10) is controlled by said spring actuated lever (15) of the throttle valve (4) so as to try to affect an air valve opening state when said throttle valve opening state is affected, and in that the opening state of said air valve (10) is delimited by a choked state of said choke valve (5) regardless of the throttle valve opening state, through interaction between said choke lever (18) and said spring actuated lever (15), such that the choke lever (18) inhibits rotation of the spring-actuated lever (15) towards the air valve opening state to thereby maintain the air valve (10) in a closed position independent of rotation of the throttle lever (11) towards the throttle valve opening state.

* * * * *